US009275599B2

(12) United States Patent
Pyun et al.

(10) Patent No.: US 9,275,599 B2
(45) Date of Patent: Mar. 1, 2016

(54) DISPLAY APPRATUS

(71) Applicant: Samsung Display Co., Ltd., Yongin, Gyeonggi-Do (KR)

(72) Inventors: Kihyun Pyun, Goyang-si (KR); Yunmi Kim, Gyeongsangnam-do (KR); Minyoung Park, Busan (KR); Kyung-Hwa Lim, Seoul (KR)

(73) Assignee: SAMSUNG DISPLAY CO., LTD. (KR)

( * ) Notice: Subject to any disclaimer, the term of this patent is extended or adjusted under 35 U.S.C. 154(b) by 66 days.

(21) Appl. No.: 14/095,900

(22) Filed: Dec. 3, 2013

(65) Prior Publication Data

US 2014/0347341 A1 Nov. 27, 2014

(30) Foreign Application Priority Data

May 23, 2013 (KR) ..... 10-2013-0058593

(51) Int. Cl.
*G09G 3/36* (2006.01)

(52) U.S. Cl.
CPC ..... *G09G 3/3696* (2013.01); *G09G 3/3677* (2013.01); *G09G 2320/0219* (2013.01); *G09G 2320/041* (2013.01)

(58) Field of Classification Search
CPC ..... G09G 3/3696; G09G 3/3233; G09G 2330/021; G09G 2300/0819; G09G 2310/0289; G09G 3/3258; G09G 2300/0852
See application file for complete search history.

(56) References Cited

U.S. PATENT DOCUMENTS

| | | | | |
|---|---|---|---|---|
| 7,071,929 | B2 * | 7/2006 | Fujii | G09G 3/3648 345/101 |
| 8,624,811 | B2 * | 1/2014 | Kim et al. | 345/87 |
| 2007/0296682 | A1 * | 12/2007 | Hwang | 345/100 |
| 2008/0231620 | A1 * | 9/2008 | Hector | G09G 3/3648 345/208 |
| 2009/0079715 | A1 * | 3/2009 | Kim | 345/204 |
| 2010/0123708 | A1 | 5/2010 | Jang et al. | |
| 2011/0157123 | A1 | 6/2011 | Cho | |
| 2011/0157132 | A1 | 6/2011 | Byun et al. | |
| 2012/0075280 | A1 * | 3/2012 | Liu et al. | 345/212 |
| 2012/0154361 | A1 * | 6/2012 | Wu et al. | 345/211 |

FOREIGN PATENT DOCUMENTS

| | | |
|---|---|---|
| KR | 1020000003152 | 1/2000 |
| KR | 1020030021873 | 3/2003 |
| KR | 1020030024660 | 3/2003 |
| KR | 1020030034869 | 5/2003 |
| KR | 100495798 | 6/2005 |
| KR | 1020060118827 | 11/2006 |
| KR | 1020080008854 | 1/2008 |
| KR | 1020110017756 | 2/2011 |
| KR | 1020110101901 | 9/2011 |

* cited by examiner

*Primary Examiner* — Olga Merkoulova
(74) *Attorney, Agent, or Firm* — Innovation Counsel LLP

(57) ABSTRACT

A display apparatus is provided which includes a display panel; a gate driver configured to drive a plurality of gate lines, a data driver configured to drive a plurality of data lines, a level shifter configured to generate a gate on voltage corresponding to an atmospheric temperature and to generate a gate clock signal, the gate on voltage becoming higher depending on a decrease in an atmospheric temperature, and a timing controller configured to control the gate driver and the data driver and to generate agate pulse signal having a pulse width corresponding to a voltage level of the gate on voltage.

16 Claims, 5 Drawing Sheets

DISPLAY APPRATUS

CROSS-REFERENCE TO RELATED APPLICATIONS

This application claims priority under 35 U.S.C. §119 to Korean Patent Application No. 10-2013-0058593 filed on May 23, 2013, the disclosure of which is incorporated by reference herein in its entirety.

BACKGROUND

The inventive concepts described herein relate to a display apparatus, and more particularly, relate to a display apparatus with improved image quality.

In general, a display apparatus may include a display panel for displaying images, and data and gate drivers for driving the display panel. The display panel may include a plurality of gate lines, a plurality of data lines, and a plurality of pixels. Each of the pixels may include a switching transistor, a liquid crystal capacitor, and a storage capacitor. The data driver may output a data driving signal to data lines. The gate driver may output a gate driving signal for driving gate lines.

The display apparatus may display images by applying a gate on voltage to a gate electrode of a switching transistor connected to a gate line while applying a data voltage corresponding to a display image to a source electrode. The data voltage applied to a liquid crystal capacitor and a storage capacitor through the turned-on switching transistor may be maintained during a predetermined time after the switching transistor is turned off. However, a gray scale voltage actually applied to the liquid crystal capacitor and the storage capacitor may be distorted by parasitic capacitance between a gate electrode and a drain electrode of the switching transistor. The parasitic capacitance may be caused by a fabrication process of the display panel. That is, a voltage difference may exist between a gray scale voltage output from the data driver and a gray scale voltage actually applied to the liquid crystal capacitor and the storage capacitor. The distorted voltage may be referred to as a kickback voltage. As the kickback voltage becomes higher and a difference between kickback voltages of switching transistors in the display panel increases, the quality of images displayed by the display panel may be deteriorated. In recent years, various techniques for compensating for the kickback voltage have been proposed.

SUMMARY

One aspect of embodiments of the inventive concept is directed to provide a display apparatus which comprises a display panel including a plurality of gate lines, a plurality of data lines, and a plurality of pixels connected to the gate and data lines; a gate driver configured to drive the plurality of gate lines; a data driver configured to drive the plurality of data lines; a level shifter configured to generate a gate on voltage corresponding to an atmospheric temperature and to generate a gate clock signal, the gate on voltage becoming higher depending on a decrease in an atmospheric temperature ; and a timing controller configured to control the gate driver and the data driver and to generate a gate pulse signal having a pulse width corresponding to a voltage level of the gate on voltage.

In example embodiments, the pulse width of the gate pulse signal has a high level section and a low level section.

In example embodiments, the timing controller sets the low-level section according to a voltage level of the gate on voltage.

In example embodiments, the timing controller comprises a reference voltage generator configured to generate a plurality of reference voltages; a comparison circuit configured to compare the plurality of reference voltages and the gate on voltage to activate one of a plurality of gate pulse selection signals based on the comparison result; and a gate pulse generator configured to generate the gate pulse selection signals having a pulse width corresponding to an activated gate pulse selection signal.

A period of the low level section corresponds to a period of a kickback slice. Duration of a kickback slice increases according to an increase in the gate on voltage. Duration of a kickback slice increases according to an increase in the lower level section.

In example embodiments, the reference voltage generator generates first to third reference voltages. The comparison circuit activates a first selection signal when a voltage level of the gate on voltage is lower than the first reference voltage and higher than the second reference voltage. The comparison circuit activates a second selection signal when a voltage level of the gate on voltage is lower than the second reference voltage and higher than the third reference voltage.

In example embodiments, the timing controller further comprising a gate pulse generator and the gate pulse generator generates the gate pulse signal having a pulse width corresponding to an activated one of the first and the second selection signals.

In example embodiments, the level shifter comprises a voltage generator configured to generate the gate on voltage and a gate off voltage; and a gate clock generator configured to receive the gate on voltage and the gate off voltage and to generate the gate clock signal swinging between the gate on voltage and the gate off voltage in response to the gate pulse signal.

In example embodiments, the gate clock generator generates the gate clock signal including a kickback slice.

In example embodiments, the level shifter detects an atmospheric temperature and generates the gate on voltage having a voltage level corresponding to the detected atmospheric temperature.

With embodiments of the inventive concept, a pulse width of a gate pulse signal may be changed according to a voltage level of a gate on voltage. Thus, since a kickback compensation voltage is variable according to a voltage level of the gate on voltage, the quality of images displayed by a display panel may be improved.

BRIEF DESCRIPTION OF THE FIGURES

The above and other objects and features will be readily apparent from the following description with reference to the following figures, wherein like reference numerals refer to like parts throughout the various figures unless otherwise specified, and wherein.

DETAILED DESCRIPTION

Figure 1:
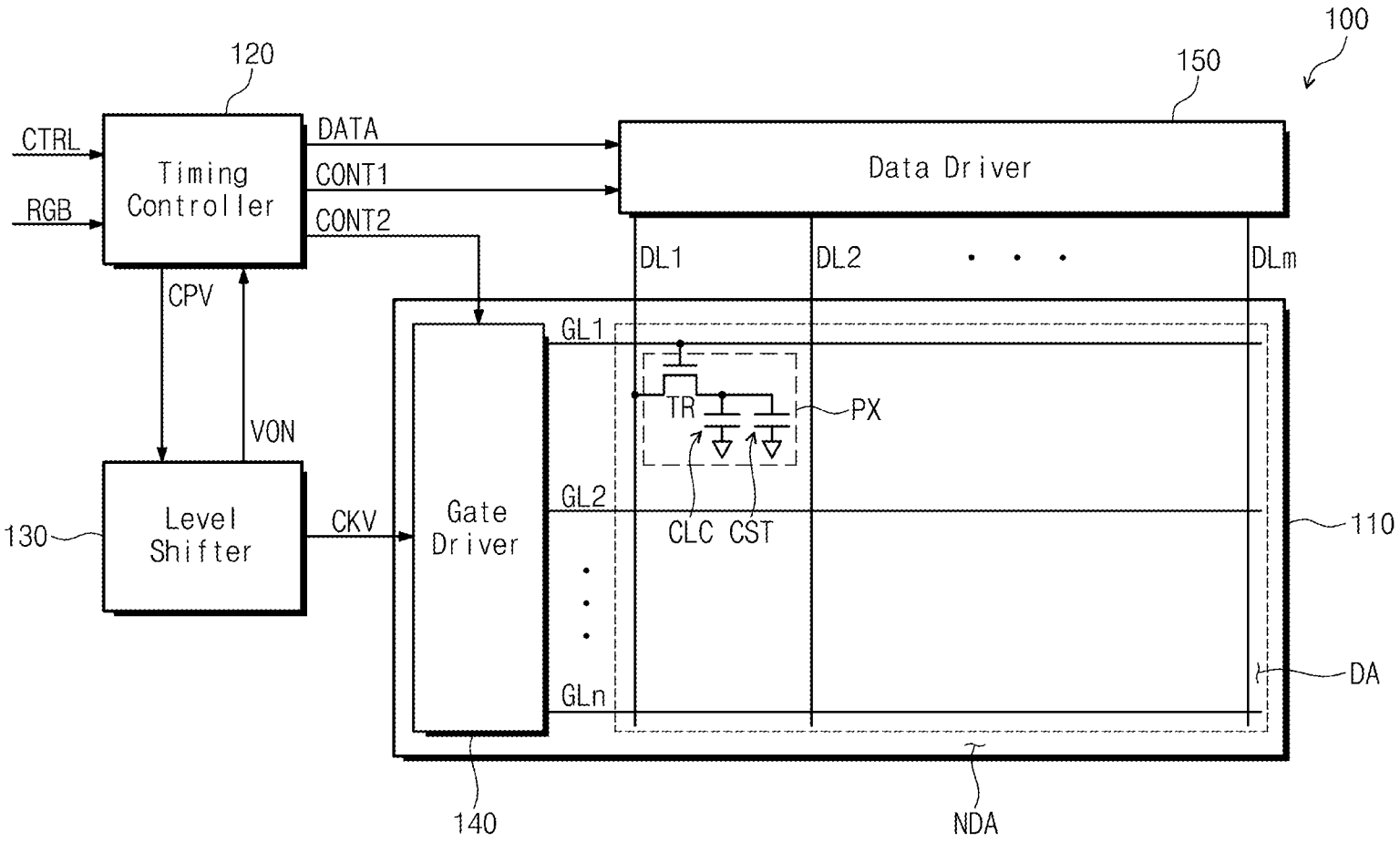
FIG. 1 is a block diagram schematically illustrating a display apparatus according to an embodiment of the inventive concept.

Embodiments will be described in detail with reference to the accompanying drawings. The inventive concept, however, may be embodied in various different forms, and should not be construed as being limited only to the illustrated embodiments. Rather, these embodiments are provided as examples so that this disclosure will be thorough and complete, and will fully convey the concept of the inventive concept to those skilled in the art. Accordingly, known processes, elements, and techniques are not described with respect to some of the embodiments of the inventive concept. Unless otherwise specified, like reference numerals denote like elements throughout the attached drawings and written description, and thus descriptions will not be repeated. In the drawings, the sizes and relative sizes of layers and regions may be exaggerated for clarity.

It will be understood that, although the terms "first", "second", "third", etc., may be used herein to describe various elements, components, regions, layers and/or sections, the described elements, components, regions, layers and/or sections are not be limited by the terms used. The terms are only used to distinguish one element, component, region, layer or section from another region, layer or section. Thus, a first element, component, region, layer or section discussed below could be termed a second element, component, region, layer or section without departing from the teachings of the inventive concept.

Spatially relative terms, such as "beneath", "below", "lower", "under", "above", "upper" and the like, may be used herein for ease of description to describe one element or feature's relationship to another element(s) or feature(s) as illustrated in the figures. It will be understood that the spatially relative terms are intended to encompass different orientations of the device in use or operation in addition to the orientation depicted in the figures. For example, if the device in the figures is turned over, elements described as "below" or "beneath" or "under" other elements or features may then be oriented "above" the other elements or features. Thus, the terms "below" and "under" can encompass both an orientation of above and below. The device may be otherwise oriented (rotated 90 degrees or at other orientations) and the spatially relative descriptors used herein interpreted accordingly. In addition, it will also be understood that when a layer is referred to as being "between" two layers, it can be the only layer between the two layers, or one or more intervening layers may also be present.

The terminology used herein is for the purpose of describing particular embodiments only and is not intended to limit the inventive concept. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof. As used herein, the term "and/or" includes any and all combinations of one or more of the associated listed items. Also, the term "exemplary" is intended to refer to an example or illustration.

It will be understood that when an element or layer is referred to as being "on", "connected to", "coupled to", or "adjacent to" another element or layer, it can either be disposed directly on, connected, coupled, or adjacent to the other element or layer, or formed with intervening elements or layers. In contrast, when an element is referred to as being "directly on," "directly connected to", "directly coupled to", or "immediately adjacent to" another element or layer, there are no intervening elements or layers present.

Unless otherwise defined, all terms (including technical and scientific terms) used herein have the same meaning as commonly understood by one of ordinary skill in the art to which this inventive concept belongs. It will be further understood that terms, such as those defined in commonly used dictionaries, should be interpreted as having a meaning that is consistent with their meaning in the context of the relevant art and/or the present specification and should not be interpreted in an idealized or overly formal sense unless expressly so defined herein.

FIG. 1 is a block diagram schematically illustrating a display apparatus according to an embodiment of the inventive concept.

Referring to FIG. 1, the display apparatus 100 may include a display panel 110, a timing controller 120, a level shifter 130, a gate driver 140, and a data driver 150.

The display panel 110 may include a display area DA and a non-display area NDA. The display area DA may include a plurality of data lines DL1 to DLm, a plurality of gate lines GL1 to GLn intersecting with the data lines DL1 to DLm, and a plurality of pixels PX connected to the data lines DL1 to DLm and the gate lines GL1 to GLn. The data lines DL1 to DLm may be insulated from the gate lines GL1 to GLn. Each pixel PX may include a switching transistor TR connected to corresponding data line and gate line, a liquid crystal capacitor CLC and a storage capacitor CST connected to the switching transistor TR.

The gate driver 140 may be disposed at one side of the non-display area NDA of the display panel 110. The gate driver 140 may be implemented by forming a circuit directly on the display panel using an amorphous silicon thin film transistor (a-Si TFT), oxide semiconductor, crystalline semiconductor, poly crystalline semiconductor, and so on. The gate driver 140 may drive the gate lines GL1 to GLn in response to a second control signal CONT2 from the timing controller 120 and a gate clock signal CKV from the level shifter 130.

The timing controller 120 may receive an image signal RGB and control signals CTRL (e.g., a horizontal synchronization signal, a vertical synchronization signal, a main clock signal, a data enable signal, etc.) from an external device. The timing controller 120 may process the image signal RGB to be suitable for an operating condition of the display panel 110 based on the control signal CTRL. The timing controller 120 may provide a data signal DATA thus processed and a first control signal CONT1 to the data driver 150. The timing controller 120 may provide the second signal CONT2 to the gate driver 140. The first control signal CONT1 may include a horizontal synchronization signal, a clock signal and a line latch signal. The second control signal CONT2 may include a vertical synchronization signal and an output enable signal. The timing controller 120 may provide a gate pulse signal CPV to the level shifter 130.

The level shifter 130 may generate a gate on voltage VON and a gate off voltage VOFF, and may output the gate clock signal CKV swinging between the gate on voltage VON and the gate off voltage VOFF in response to the gate pulse signal CPV from the timing controller 120. In exemplary embodiments, the level shifter 130 may output a gate clock signal CKV in response to a gate pulse signal CPV. In other exemplary embodiments, the level shifter 130 may output a plurality of gate clock signals having different phases in response to a gate pulse signal CPV. In exemplary embodiments, the gate on voltage VON generated by the level shifter 130 may be provided to the timing controller 120. The timing controller 120 may generate the gate pulse signal CPV having a pulse width corresponding to a voltage level of the gate on voltage VON. This will be described in detail later.

The data driver 150 may output gray scale voltages for driving the data lines DL1 to DLm in response to the data signal DATA and the first control signal CONT1 from the timing controller 120.

A switching transistor TR may be turned on while a gate driving signal having the gate on voltage VON is applied to one of the gate lines GL1 to GLn through the gate driver 140. Gray scale voltages may be provided to the data lines DL1 to DLm from the data driver 150 during the gate on voltage VON is applied to one of the gate lines GL1 to GLn. A period when the switching transistors TR connected to a gate line are supplied with the gate on voltage VON may be referred to as "one horizontal period" or "1H".

The electron mobility of transistors in the gate driver 140 may be influenced by an atmospheric temperature. The electron mobility of a transistor may become fast in proportion to an increase in an atmospheric temperature and may become slow in proportion to a decrease in an atmospheric temperature. Since the electron mobility influences a driving capacity of the transistor, it is necessary to compensate for the electron mobility for a high-speed operation.

The level shifter 130 may detect an atmospheric temperature, and may change a voltage level of the gate on voltage VON according to the detection result. For example, the level shifter 130 may generate the gate on voltage VON of about 31V when the atmospheric temperature is higher than about 10° C. The level shifter 130 may generate the gate on voltage VON higher than about 31V when the atmospheric temperature is lower than about 10° C. If a driving capacity of a transistor in the gate driver 140 is lowered due to a decrease in a atmospheric temperature, a swing width of the gate clock signal CKV may become larger by increasing the gate on voltage VON. Thus, it is possible to improve a driving capacity of a transistor.

A gray scale voltage applied to the capacitors CLC and CST through the switching transistor TR has to be maintained during a predetermined time after the switching transistor TR is turned off. However, a gray scale voltage actually applied to the liquid crystal capacitor CLC and the storage capacitor CST may be distorted by parasitic capacitance between a gate electrode and a drain electrode of the switching transistor TR Cgd. The parasitic capacitance Cgd may be caused by a fabrication process of the display panel. A kickback voltage, a voltage difference between a gray scale voltage from the data driver 150 and a gray scale voltage actually applied to the liquid crystal capacitor CLC and the storage capacitor CST, may be expressed by the following equation 1.

$$Vk = \frac{Cgd}{CLC - CST + Cgd} \times (VON - VOFF) \quad (1)$$

According to an increase in a voltage level of the gate on voltage VON, the kickback voltage Vk may be increased seriously. As described above, when an atmospheric temperature becomes low, the gate on voltage VON of the gate clock signal CKV provided to the gate driver 140 may be increased to improve a driving capacity of a transistor in the gate driver 140. The kickback voltage Vk in the display panel 110 may be increased due to the increase in the gate on voltage VON.

Figure 2:
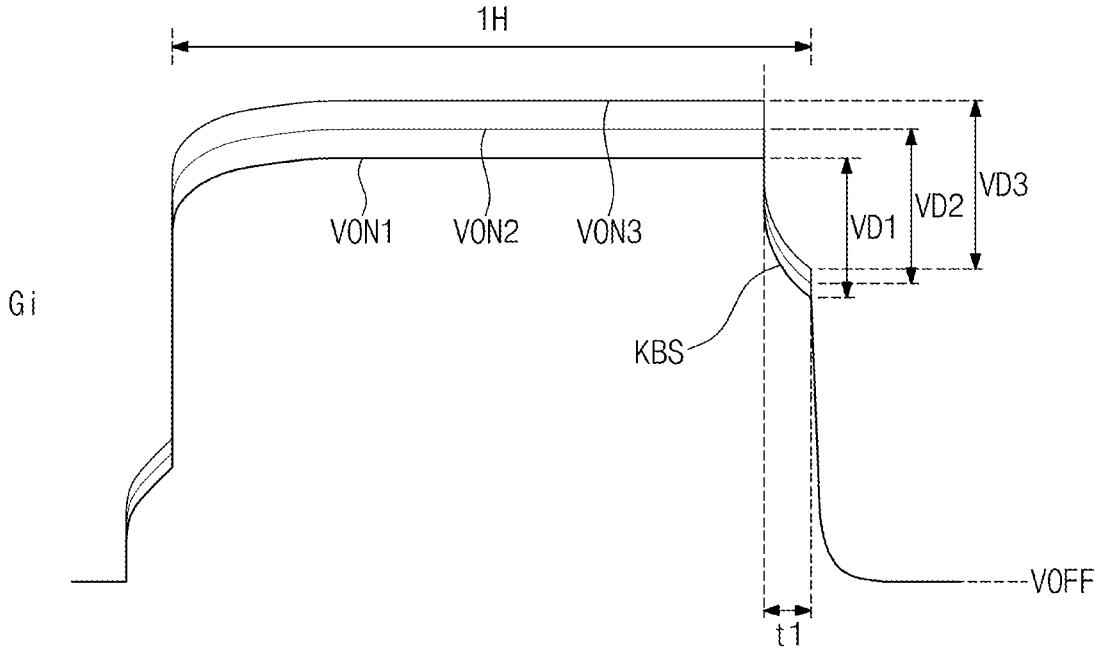
FIG. 2 is a diagram a gate driving signal output from a gate driver in FIG. 1 during a time corresponding to "1H"

FIG. 2 is a diagram a gate driving signal output from a gate driver in FIG. 1 during a time corresponding to "1H".

Referring to FIGS. 1 and 2, a gate driving signal Gi provided to one GLi of gate lines GL1 to GLn may swing between a gate on voltage level and a gate off voltage level. To minimize influence of a kickback voltage Vk, when the gate driving signal Gi is falling from the gate on voltage level to the gate off voltage level, the gate driving signal may include a kickback slice KBS where the gate on voltage level is lowered during a kickback time t1.

Although a voltage level of the gate driving signal Gi increases from a first gate on voltage VON1 to a third gate on voltage VON3, start time of the kickback slice KBS of the first and the third gate on voltages VON1 and VON3 may be equal to each other. For this reason, a voltage drop level VD1 of the first gate on voltage VON1 may be similar to a voltage drop level VD3 of the third gate on voltage VON3. As a result, compensation effect of the kickback voltage Vk of the third gate on voltage VON3 may be reduced due to an increase in the gate on voltage VON.

Figure 3:
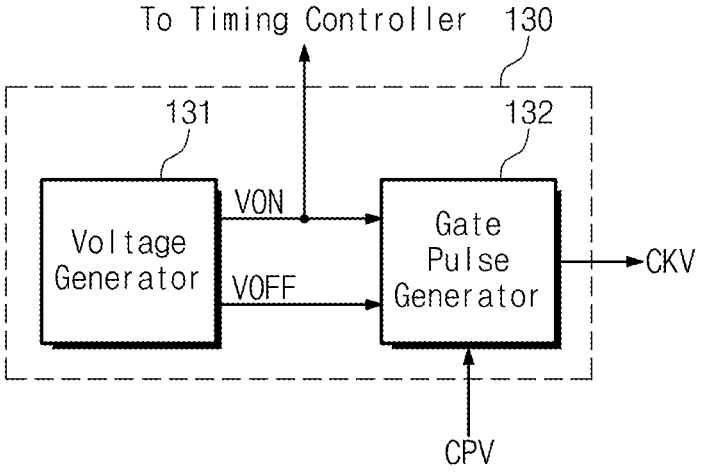
FIG. 3 is a block diagram schematically illustrating a level shifter illustrated in FIG. 1.

FIG. 3 is a block diagram schematically illustrating a level shifter illustrated in FIG. 1.

Referring to FIG. 3, a level shifter 130 may include a voltage generator 131 and a gate clock generator 132. The voltage generator 131 may generate a gate on voltage VON and a gate off voltage VOFF. Although not shown, the voltage generator 131 may include a temperature detector, and may generate the gate on voltage VON having a compensated voltage level corresponding to a detected atmospheric temperature. For example, the voltage generator 131 may generate the gate on voltage VON having a high voltage level when an atmospheric temperature is lower than a reference temperature. The voltage generator 131 may generate the gate on voltage VON having a low voltage level when an atmospheric temperature is higher than the reference temperature. The gate on voltage VON and the gate off voltage VOFF may be provided to the gate clock generator 132.

The gate clock generator 132 may generate a gate clock signal CKV swinging between the gate on voltage VON and the gate off voltage VOFF in response to a gate pulse signal CPV from a timing controller 120 (refer to FIG. 1). The gate on voltage VON generated by the voltage generator 131 may be provided to the timing controller 120.

Figure 4:
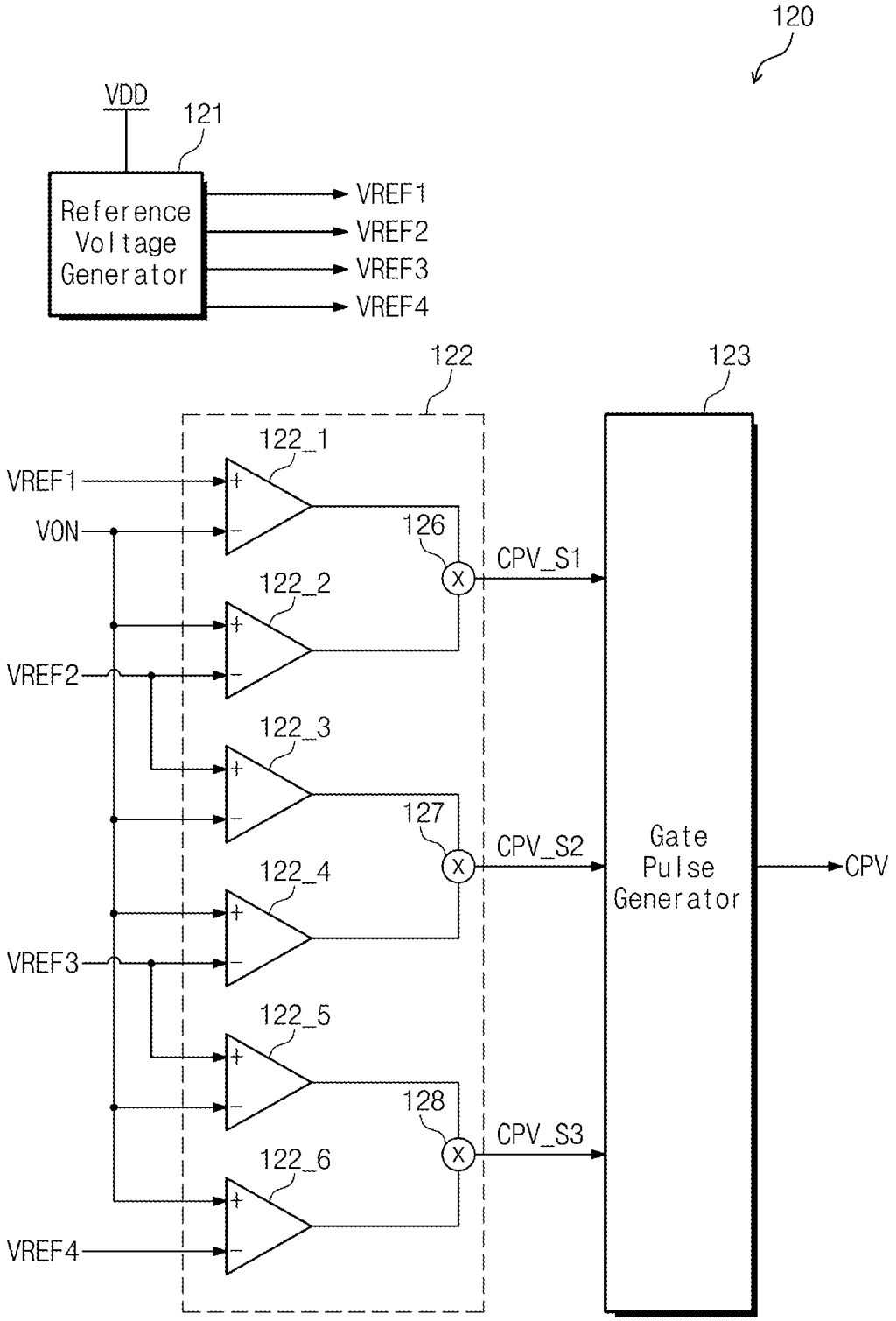
FIG. 4 is a block diagram schematically illustrating a timing controller illustrated in FIG. 1.

FIG. 4 is a block diagram schematically illustrating a timing controller illustrated in FIG. 1.

Referring to FIG. 4, a timing controller 120 may include a reference voltage generator 121, a comparison circuit 122, and a gate pulse generator 123. The reference voltage generator 121 may generate first to fourth reference voltages VREF1 to VREF4. Voltage levels of the first to fourth reference voltages VREF1 to VREF4 may be different from one another. For example, the reference voltage generator 121 may include a plurality of resistors connected in series between a power supply voltage VDD and a ground voltage, and may output voltages of connection nodes of the plurality of resistors as the first to the fourth reference voltages VREF1 to VREF4. In exemplary embodiments, the first reference voltage VREF1 may have the highest voltage level, and the fourth reference voltage VREF4 may have the lowest voltage level.

The comparison circuit 122 may include a plurality of comparators 122_1 to 122_6 and logic gates 126 to 128. Each of the comparators 122_1 to 122_6 may receive a corresponding reference voltage and a gate on voltage VON from a level shifter 130 in FIG. 1. For example, the comparator 122_1 may have a positive input terminal (+) connected to receive the first reference voltage VREF1 and a negative input terminal (−) connected to the gate on voltage VON. The comparator 122_2 may have a positive input terminal (+) connected to receive the gate on voltage VON and a negative input terminal (−) connected to the second reference voltage VREF2.

The comparator 122_3 may have a positive input terminal (+) connected to receive the second reference voltage VREF2 and a negative input terminal (−) connected to the gate on voltage VON. The comparator 122_4 may have a positive input terminal (+) connected to receive the gate on voltage VON and a negative input terminal (−) connected to the third reference voltage VREF3.

The comparator 122_5 may have a positive input terminal (+) connected to receive the third reference voltage VREF3 and a negative input terminal (−) connected to the gate on voltage VON. The comparator 122_6 may have a positive input terminal (+) connected to receive the gate on voltage VON and a negative input terminal (−) connected to the fourth reference voltage VREF4.

The logic gate 126 may output a first gate pulse selection signal CPV_S1 in response to output signals of the comparators 122_1 and 122_2. When both of the output signals of the comparators 122_1 and 122_2 have a high level, the logic gate 126 may output a high level of first gate pulse selection signal CPV_S1.

The logic gate 127 may output a second gate pulse selection signal CPV_S2 in response to output signals of the comparators 122_3 and 122_4. When both of the output signals of the comparators 122_3 and 122_4 have a high level, the logic gate 127 may output a high level of second gate pulse selection signal CPV_S2.

The logic gate 128 may output a third gate pulse selection signal CPV_S3 in response to output signals of the comparators 122_5 and 122_6. When both of the output signals of the comparators 122_5 and 122_6 have a high level, the logic gate 128 may output a high level of third gate pulse selection signal CPV_S3.

For example, when a voltage level of the gate on voltage VON from the level shifter 130 is between the first reference voltage VREF1 and the second reference voltage VREF2, the first gate pulse selection signal CPV_S1 may be activated to a high level. When a voltage level of the gate on voltage VON from the level shifter 130 is between the second reference voltage VREF2 and the third reference voltage VREF3, the second gate pulse selection signal CPV_S2 may be activated to a high level. When a voltage level of the gate on voltage VON from the level shifter 130 is between the third reference voltage VREF3 and the fourth reference voltage VREF4, the third gate pulse selection signal CPV_S3 may be activated to a high level.

The gate pulse generator 123 may output the gate pulse signal CPV in response to the first to third gate pulse selection signals CPV_S1 to CPV_S3.

Figure 5:
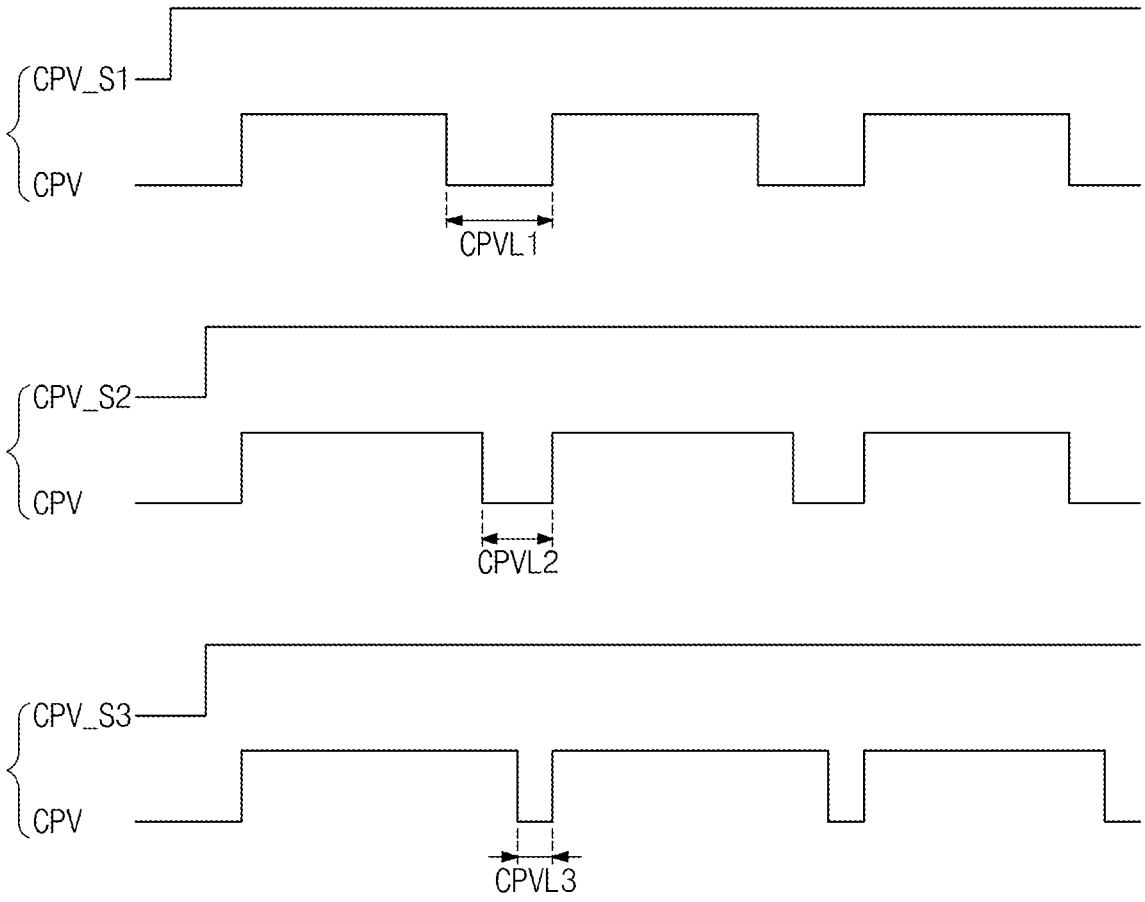
FIG. 5 is a timing diagram schematically illustrating a gate pulse signal generated by a gate pulse generator in FIG. 4 in response to first to third gate pulse selection signals from a comparison circuit in FIG. 4.
Figure 6:
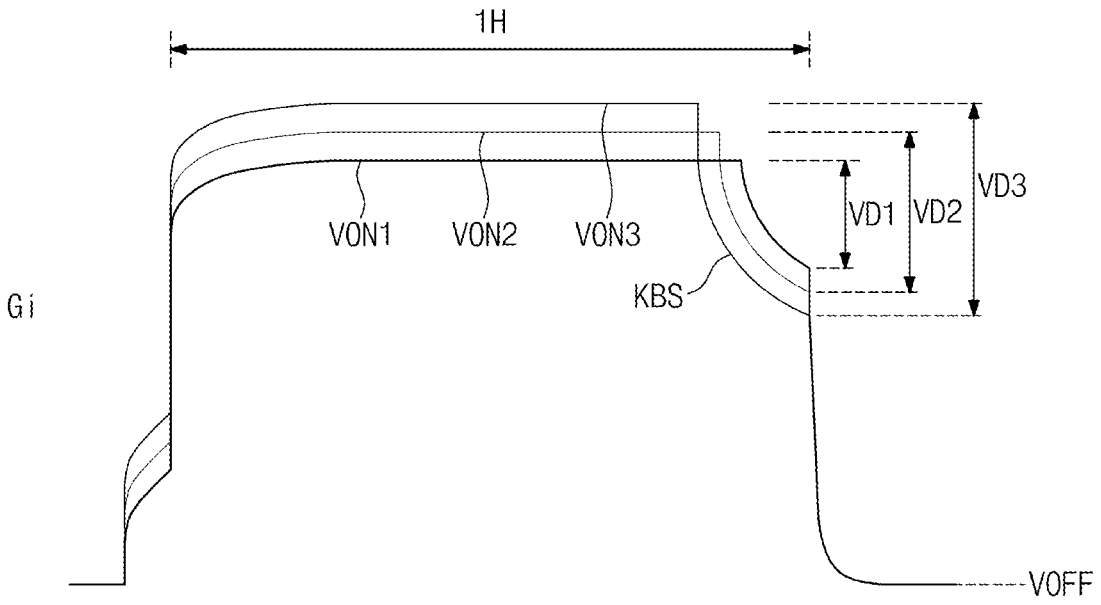
FIG. 6 is a diagram schematically illustrating a gate driving signal output from a gate driver in FIG. 1.

FIG. 5 is a timing diagram schematically illustrating a gate pulse signal generated by a gate pulse generator in FIG. 4 in response to first to third gate pulse selection signals CPV_S1 to CPV_S3 from a comparison circuit in FIG. 4. FIG. 6 is a diagram schematically illustrating a gate driving signal output from a gate driver in FIG. 1.

Referring to FIGS. 4 to 6, if a first gate pulse selection signal CPV_S1 is activated to a high level, a gate pulse generator 123 may generate a gate pulse signal CPV having a first low-level pulse width CPVL1. When a second gate pulse selection signal CPV_S2 is activated to a high level, the gate pulse generator 123 may generate the gate pulse signal CPV having a second low-level pulse width CPVL2. When a third gate pulse selection signal CPV_S3 is activated to a high level, the gate pulse generator 123 may generate the gate pulse signal CPV having a third low-level pulse width CPVL3. Here, CPVL1>CPVL2>CPVL3.

The higher a voltage level of a gate on voltage VON generated from a level shifter 130 in FIG. 1 becomes, the wider a low-level pulse width of the gate pulse signal CPV is. For example, since the level shifter 130 generates a third voltage level VON3 of about 38V when an atmospheric temperature is lower than about −7° C., the first gate pulse selection signal CPV_S1 may be activated to a high level. Thus, a timing controller 120 may generate the gate pulse signal CPV having the first low-level pulse width CPVL1.

Since the level shifter 130 generates a second voltage level VON2 of about 35V when the atmospheric temperature is lower than about 10° C. and higher than about −7° C., the second gate pulse selection signal CPV_S2 may be activated to a high level. Thus, the timing controller 120 may generate the gate pulse signal CPV having the second low-level pulse width CPVL2.

Since the level shifter 130 generates a first voltage level VON1 of about 31V when the atmospheric temperature is higher than about 10° C., the third gate pulse selection signal CPV_S3 may be activated to a high level. Thus, the timing controller 120 may generate the gate pulse signal CPV having the third low-level pulse width CPVL3.

When a driving capacity of a transistor in a gate driver 140 is lowered due to a decrease in an atmospheric temperature, a swing width of the gate clock signal CKV may be increased by raising the gate on voltage VON and a pulse width of the gate clock signal CPV having a high-level section may be reduced such that a start time of a kickback slice KBS becomes fast. The higher a voltage level of the gate on voltage VON becomes, the faster a start time of the kickback slice KBS of the gate clock signal CPV is. Thus, the higher a voltage level of the gate on voltage VON becomes, the wider a voltage drop width of the gate clock signal CPV (VD3>VD2>VD1) is. That is, a voltage drop width of a kickback slice may increase according to an increase in a voltage level of the gate on voltage VON. Thus, it is possible to compensate a lowered driving capacity without deteriorating a kickback voltage.

While the inventive concept has been described with reference to exemplary embodiments, it will be apparent to those skilled in the art that various changes and modifications may be made without departing from the spirit and scope of the present invention. Therefore, it should be understood that the above embodiments are not limiting, but illustrative.

What is claimed is:

1. A display apparatus, comprising:

a display panel including a plurality of gate lines, a plurality of data lines, and a plurality of pixels connected with the gate and data lines;

a gate driver configured to drive the plurality of gate lines;

a data driver configured to drive the plurality of data lines;

a level shifter configured to generate a gate on voltage and to provide a gate clock signal to the gate driver based on a gate pulse signal and the gate on voltage, ; and a timing controller configured to control the gate driver and the data driver and to generate gate pulse signals having different pulse widths according to different voltage levels of the gate on voltage, wherein the level shifter detects an atmospheric temperature and generates the gate on voltage having a voltage level according to the detected atmospheric temperature.

2. The display apparatus of claim 1, wherein the gate pulse signal has a high level section and a low level section, and wherein the timing controller sets the low-level section of the gate pulse signal according to a voltage level of the gate on voltage.

3. The display apparatus of claim 2, wherein the timing controller comprises:

a reference voltage generator configured to generate a plurality of reference voltages;

a comparison circuit configured to compare the plurality of reference voltages and the gate on voltage to activate one of a plurality of gate pulse selection signals based on the comparison result; and a gate pulse generator configured to generate the gate pulse signal having a pulse width corresponding to an activated gate pulse selection signal.

4. The display apparatus of claim 3, wherein duration of a kickback slice corresponds to a period of the low level section of the gate pulse signal.

5. The display apparatus of claim 4, wherein the duration of a kickback slice increases according to an increase in the gate on voltage.

6. The display apparatus of claim 4, wherein the duration of a kickback slice increases according to an increase in the lower level section of the gate pulse signal.

7. The display apparatus of claim 3, wherein the reference voltage generator generates first to third reference voltages;

wherein the comparison circuit activates a first selection signal when a voltage level of the gate on voltage is lower than the first reference voltage and higher than the second reference voltage; and wherein the comparison circuit activates a second selection signal when a voltage level of the gate on voltage is lower than the second reference voltage and higher than the third reference voltage.

8. The display apparatus of claim 7, wherein duration of a kickback slice corresponds to a period where the gate on voltage level is lowered during a kickback time.

9. The display apparatus of claim 8, wherein the duration of a kickback slice increases according to an increase in gate on voltage.

10. The display apparatus of claim 2, wherein duration of a kickback slice corresponds to a period of the low level section of the gate pulse signal.

11. The display apparatus of claim 10, wherein the duration of a kickback slice increases according to an increase in gate on voltage.

12. The display apparatus of claim 1, wherein duration of a kickback slice corresponds to a period where the gate on voltage level is lowered during a kickback time.

13. The display apparatus of claim 12, wherein the duration of a kickback slice increases according to an increase in gate on voltage.

14. The display apparatus of claim 3, wherein the timing controller further comprising a gate pulse generator, and wherein the gate pulse generator generates the gate pulse signal having a pulse width corresponding to an activated one of the first and the second selection signals.

15. The display apparatus of claim 1, wherein the level shifter comprises:

a voltage generator configured to generate the gate on voltage and a gate off voltage; and a gate clock generator configured to receive the gate on voltage and the gate off voltage and to generate the gate clock signal swinging between the gate on voltage and the gate off voltage in response to the gate pulse signal.

16. The display apparatus of claim 9, wherein the gate clock generator generates the gate clock signal including a kickback slice.

* * * * *